US011306628B2

(12) United States Patent
Kim et al.

(10) Patent No.: US 11,306,628 B2
(45) **Date of Patent: *Apr. 19, 2022**

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventors: Hyeon Woo Kim, Seoul (KR); Kyoung Pyo Ha, Seongnam-si (KR); Back Sik Kim, Osan-si (KR); Jong Gu Kim, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/113,012

(22) Filed: Dec. 5, 2020

(65) Prior Publication Data

US 2021/0381404 A1 Dec. 9, 2021

(30) Foreign Application Priority Data

Jun. 9, 2020 (KR) ..... 10-2020-0069740

(51) Int. Cl.
*F01L 1/356* (2006.01)
*F01L 13/00* (2006.01)
*F01L 1/047* (2006.01)

(52) U.S. Cl.
CPC ..... *F01L 13/0063* (2013.01); *F01L 1/047* (2013.01); *F01L 1/356* (2013.01);
(Continued)

(58) Field of Classification Search
CPC . F01L 13/0015; F01L 1/356; F01L 2013/103; F01L 2001/0473;
(Continued)

(56) References Cited

U.S. PATENT DOCUMENTS 8,464,676 B2 * 6/2013 Yang ..... F01L 1/352 123/90.17
8,813,704 B2 8/2014 Kim et al.
(Continued)

FOREIGN PATENT DOCUMENTS

EP 3486441 A1 5/2019
EP 3767083 A1 1/2021
KR 10-2021-0008598 A 1/2021

OTHER PUBLICATIONS

European Extended Search Report for European Patent Application No. EP 20211580.4 dated May 26, 2021.

*Primary Examiner* — Patrick Hamo
*Assistant Examiner* — Wesley G Harris
(74) *Attorney, Agent, or Firm* — Morgan, Lewis & Bockius LLP

(57) ABSTRACT

A continuously variable valve duration apparatus includes a camshaft, a cam unit on which a cam is formed, a guide bracket including an upper guide boss, an internal wheel configured to transmit rotation of the camshaft to the cam unit, a wheel housing in which the internal wheel is rotatably inserted, wherein a guide thread is formed in a portion of the wheel housing, and of which a guide shaft is formed to be movably inserted into the upper guide boss, a worm wheel to which an internal thread engaging with the guide thread is formed in the worm wheel, and to which an external thread is formed thereon, a control shaft on which a control worm engaged with the external thread is formed, and an
(Continued)

upper bushing mounted on a lower portion of the upper guide boss to support the guide shaft.

20 Claims, 18 Drawing Sheets

(52) U.S. Cl.
CPC ..... *F01L 2001/0473* (2013.01); *F01L 2001/0475* (2013.01); *F01L 2810/03* (2013.01); *F01L 2810/04* (2013.01); *F01L 2820/032* (2013.01)

(58) Field of Classification Search
CPC ..... F01L 2001/0537; F01L 13/0026; F01L 13/0063; F01L 1/047; F01L 2001/0475
USPC ..... 123/90.17
See application file for complete search history.

(56) References Cited

U.S. PATENT DOCUMENTS

| | | | | |
|---|---|---|---|---|
| 9,512,748 | B2 | 12/2016 | Kim et al. | |
| 9,574,467 | B2 | 2/2017 | Ha | |
| 9,869,215 | B2 | 1/2018 | Son et al. | |
| 10,927,771 | B2 * | 2/2021 | Kim | F01L 1/0532 |
| 2017/0089230 | A1 * | 3/2017 | Son | F01L 13/0036 |
| 2017/0284238 | A1 | 10/2017 | Son et al. | |

* cited by examiner

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2020-0069740 filed on Jun. 9, 2020, the entire contents of which is incorporated herein for all purposes by this reference.

NAMES OF THE PARTIES TO A JOINT RESEARCH AGREEMENT

Hyundai Motor Company and Kia Motors Corporation were parties to a joint research agreement prior to the effective filing date of the instant application.

BACKGROUND OF THE INVENTION

Field of the Invention

The present invention relates to a continuously variable valve duration apparatus and an engine provided with the same. More particularly, the present invention relates to a continuously variable valve duration apparatus an engine provided with the same which may vary the opening duration of a valve according to operation conditions of an engine with a simple construction.

Description of Related Art

An internal combustion engine generates power by combusting fuel in a combustion chamber in an air media drawn into the chamber. Intake valves are operated by a camshaft to intake the air, and the air is drawn into the combustion chamber while the intake valves are open. Furthermore, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. To achieve such optimal valve operation depending on the rotation speed of the engine, various researches, such as designing of a plurality of cams and a continuously variable valve lift (CVVL) that can change valve lift according to engine speed, have been undertaken.

Also, to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are direct to providing a continuously variable valve duration apparatus and an engine provided with the same which may vary opening duration of a valve according to operation conditions of an engine and reduce noise and vibration.

A continuously variable valve duration apparatus according to various exemplary embodiments of the present invention may include a camshaft, a cam unit on which a cam is formed, wherein the camshaft is inserted into the cam unit, a guide bracket including an upper guide boss, an internal wheel configured to transmit rotation of the camshaft to the cam unit, a wheel housing in which the internal wheel is rotatably inserted, wherein a guide thread is formed in a portion of the wheel housing, and of which a guide shaft is formed to be movably inserted into the upper guide boss, a worm wheel to which an internal thread engaging with the guide thread is formed in the worm wheel, and to which an external thread is formed thereon, a control shaft on which a control worm engaged with the external thread is formed, and an upper bushing mounted on a lower portion of the upper guide boss to support the guide shaft.

The continuously variable valve duration apparatus may further include a lower guide boss formed on the guide bracket, and a guide rod formed at the wheel housing inserted into the lower guide boss to guide the movement of the wheel housing.

The continuously variable valve duration apparatus may further include a lower bushing mounted on a lower portion of the lower guide boss to support the guide rod.

A center portion of the internal wheel may deviate from an imaginary line connecting the upper guide boss and the lower guide boss.

The continuously variable valve duration apparatus may further include an insert mounted between the wheel housing and the guide bracket.

The insert may be fixed to any one of the wheel housing and the guide bracket.

The insert may be made of plastic material.

A cross-section of the insert may be formed in a "U" shape.

A control shaft hole that supports the control shaft may be formed at the guide bracket.

The continuously variable valve duration apparatus may further include a control shaft bearing mounted on the control shaft hole to support rotation of the control shaft.

The continuously variable valve duration apparatus may further include a thrust bearing mounted on the upper guide boss to support the worm wheel.

The continuously variable valve duration apparatus may further include a stepped surface that prevents rotation of the wheel housing is formed at the guide bracket.

The continuously variable valve duration apparatus may further include a first sliding hole and a second sliding hole respectively formed at the internal wheel, a cam slot formed at the cam unit, a roller wheel connected to the camshaft and rotatably inserted into the first sliding hole, and a roller cam slidably inserted into the cam slot and rotatably inserted into the second sliding hole.

The roller cam may include a roller cam body slidably inserted into the cam slot, a cam head rotatably inserted into the second sliding hole, and a protrusion configured to inhibit the roller cam from being removed.

The roller wheel may include a wheel body slidably connected to the camshaft, and a wheel head rotatably inserted into the first sliding hole.

The continuously variable valve duration apparatus may further include a camshaft oil hole formed within the camshaft in a longitudinal direction thereof, a body oil hole formed at the wheel body of the roller wheel and configured to communicate with the camshaft oil hole, and an oil groove formed at the wheel head of the roller wheel and configured to communicate with the body oil hole.

The cam unit may include a first cam portion and a second cam portion which are disposed corresponding to a cylinder and an adjacent cylinder respectively, and the internal wheel may include a first internal wheel and a second internal wheel of transmitting the rotation of the camshaft to the first cam portion and the second cam portion, respectively.

The first internal wheel and the second internal wheel are rotatably connected to each other.

The continuously variable valve duration apparatus may further include first and second bearings internally disposed within the wheel housing and configured to support the first internal wheel and the second internal wheel respectively.

An engine according to various exemplary embodiments of the present invention may be provided with the continuously variable valve duration apparatus.

As described above, a continuously variable valve duration apparatus according to various exemplary embodiments of the present invention may vary an opening duration of a valve according to operation conditions of an engine, with a simple construction.

In various exemplary embodiments of the present invention, the continuously variable valve duration apparatus is configured for preventing wear and reinforcing strength by applying a bushing between the wheel housing and the guide bracket.

The continuously variable valve duration apparatus according to various exemplary embodiments of the present invention prevents rotation of the wheel housing by applying an insert between the wheel housing and the guide bracket, and reduces noise and vibration.

The continuously variable valve duration apparatus according to various exemplary embodiments of the present invention may be reduced in size and thus an entire height of a valve train may be reduced.

Since the continuously variable valve duration apparatus may be applied to an existing engine without excessive modification, thus productivity may be enhanced and production cost may be reduced.

The continuously variable valve duration apparatus according to various exemplary embodiments of the present invention can reduce noise and vibration by applying a wheel elastic portion even if there is a production error in the parts.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
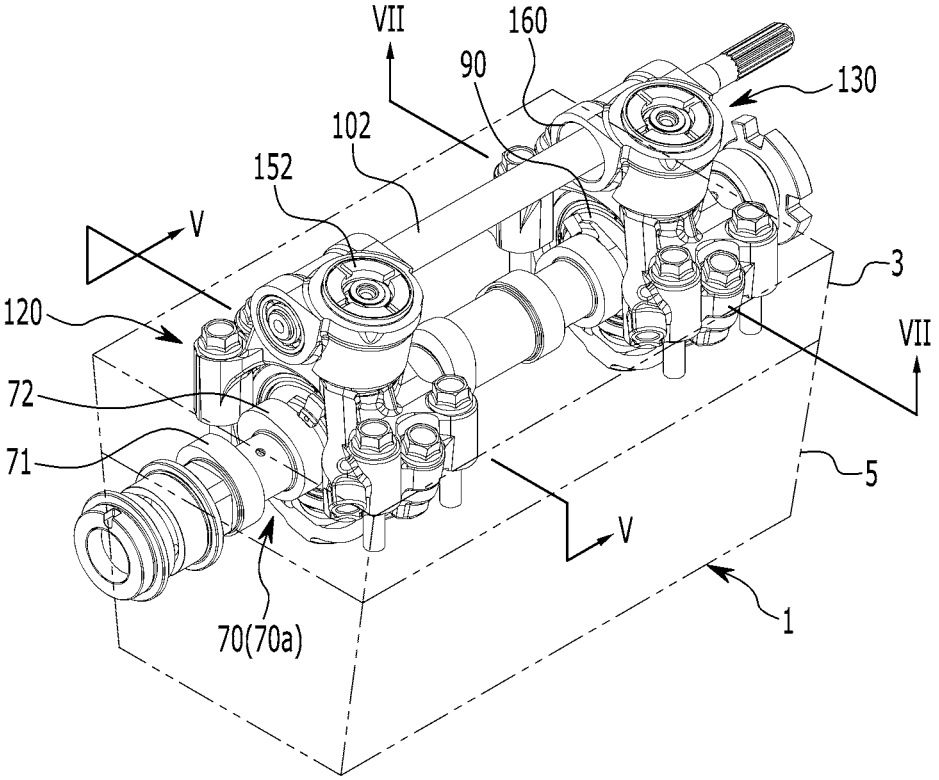
FIG. 1 is a perspective view of an engine provided with a continuously variable valve duration apparatus according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Parts marked with the same reference number throughout the specification mean the same constituent elements.

In the drawings, the thickness of layers, films, panels, regions, etc., are exaggerated for clarity.

Throughout the specification, unless explicitly described to the contrary, the word "comprise", and variations such as "comprises" or "comprising", will be understood to imply the inclusion of stated elements but not the exclusion of any other elements.

Various exemplary embodiments of the present invention will hereinafter be described in detail with reference to the accompanying drawings.

Figure 2:
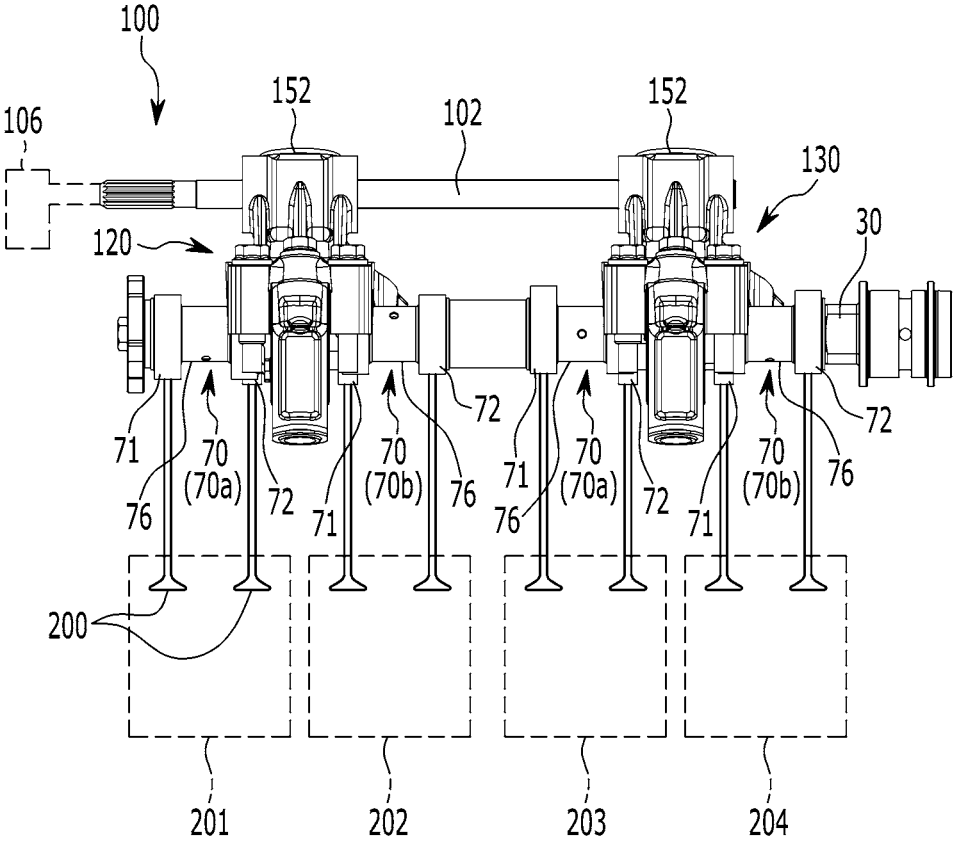
FIG. 2 is a side view of a continuously variable valve duration apparatus according to various exemplary embodiments of the present invention.

FIG. 1 is a perspective view of an engine provided with a continuously variable valve duration apparatus according to various exemplary embodiments of the present invention, and FIG. 2 is a side view of a continuously variable valve duration apparatus according to various exemplary embodiments of the present invention.

Figure 3:
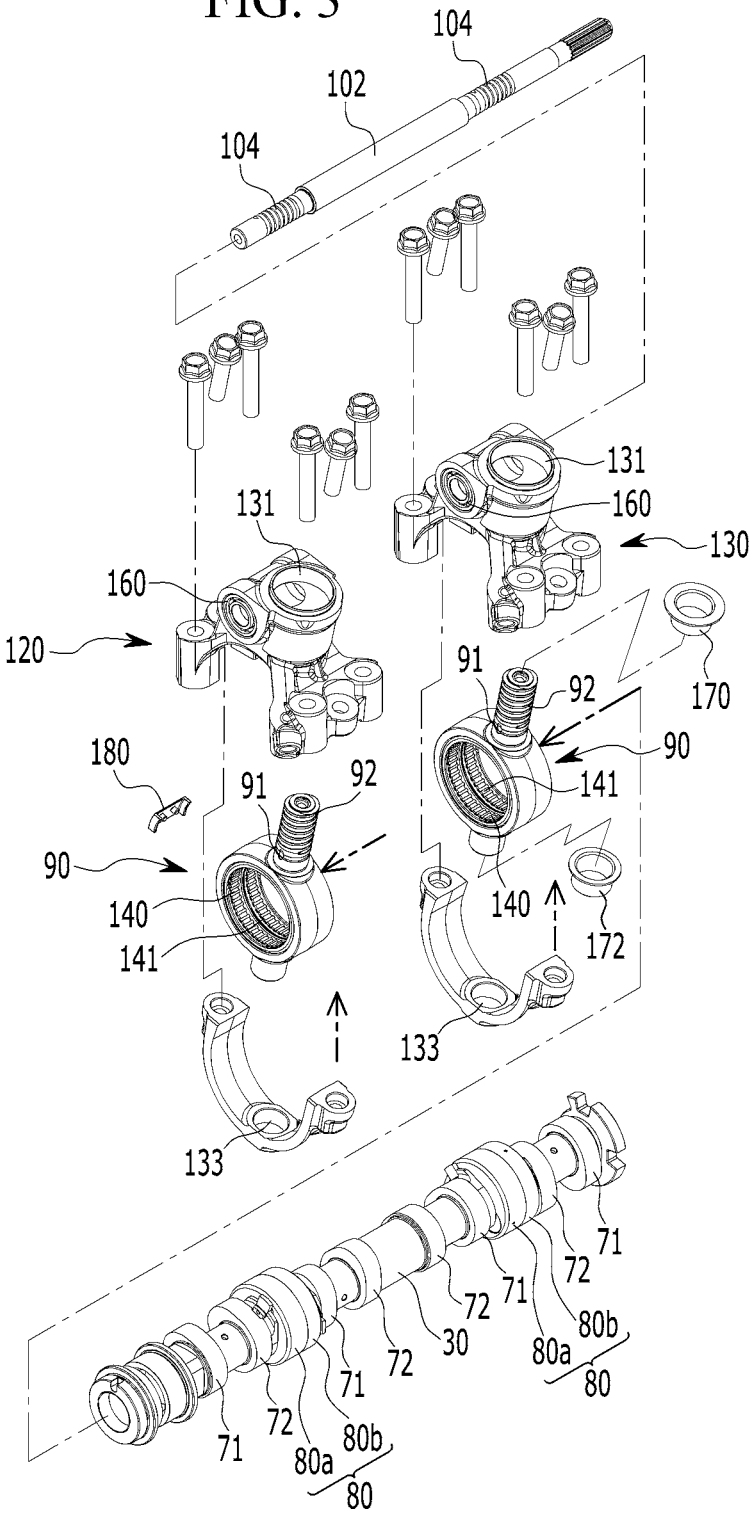
FIG. 3 is an exploded perspective view of a continuously variable valve duration apparatus according to various exemplary embodiments of the present invention.
Figure 4:
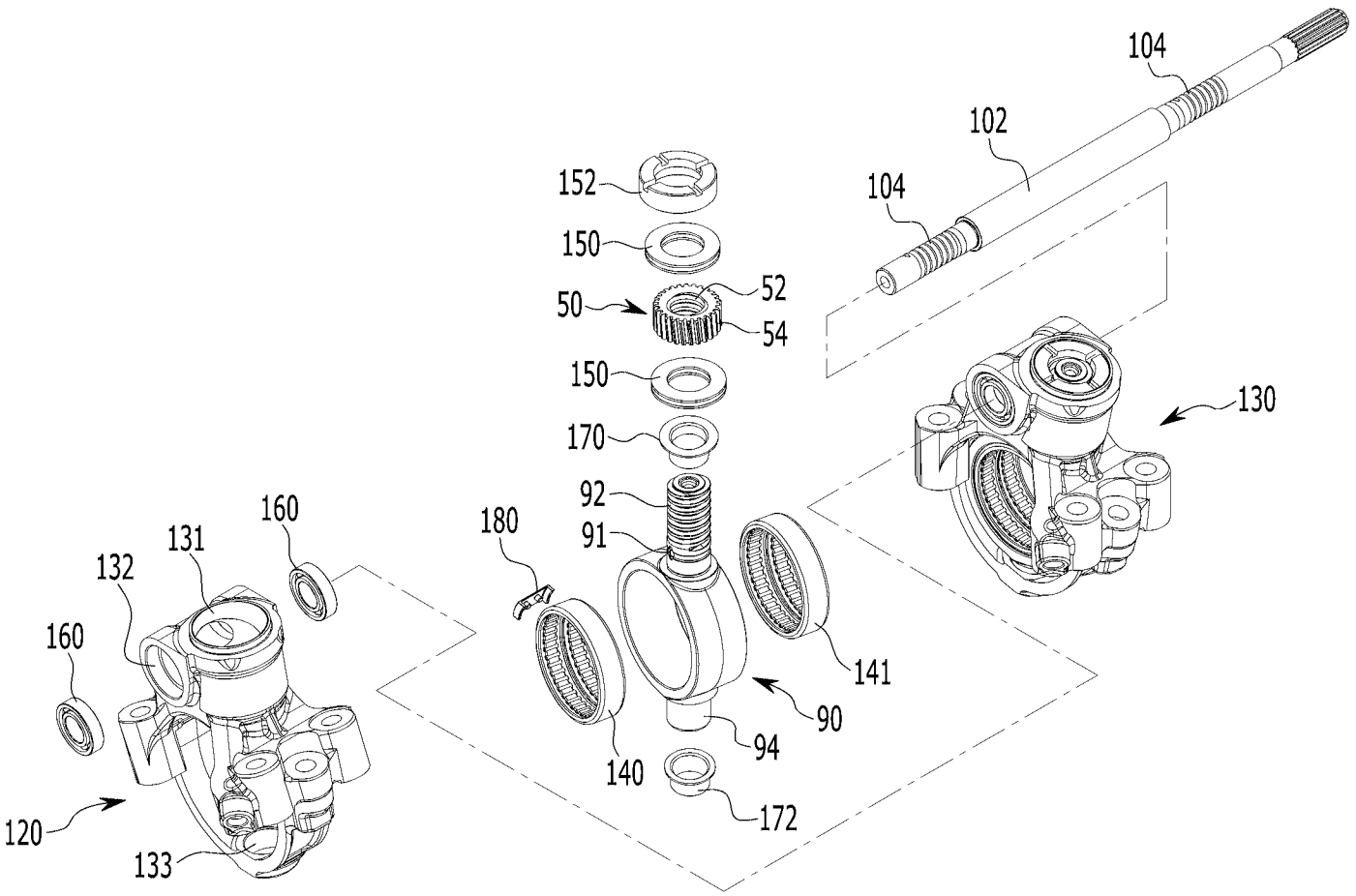
FIG. 4 is a partial perspective view of a continuously variable valve duration apparatus according to various exemplary embodiments of the present invention.

FIG. 3 is an exploded perspective view of a continuously variable valve duration apparatus according to various exemplary embodiments of the present invention, and FIG. 4 is a partial perspective view of a continuously variable valve duration apparatus according to various exemplary embodiments of the present invention.

Figure 5:
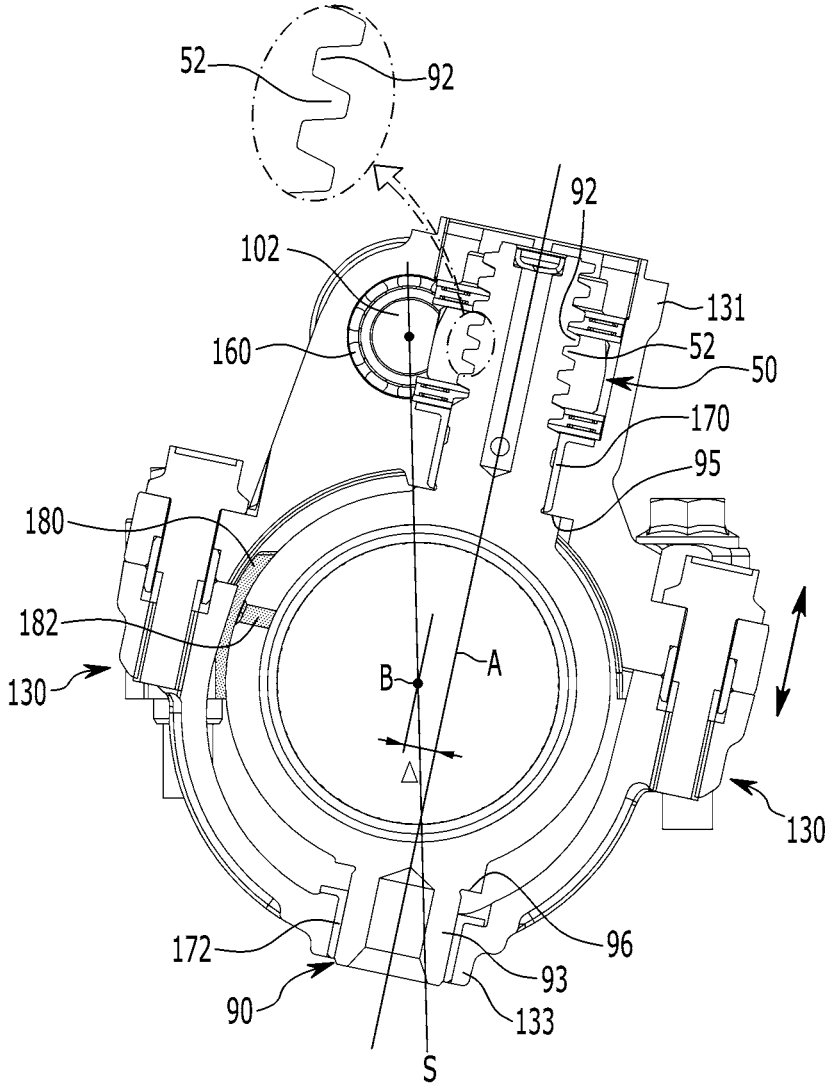
FIG. 5 is a cross-sectional view along line V-V of FIG. 1.
Figure 6:
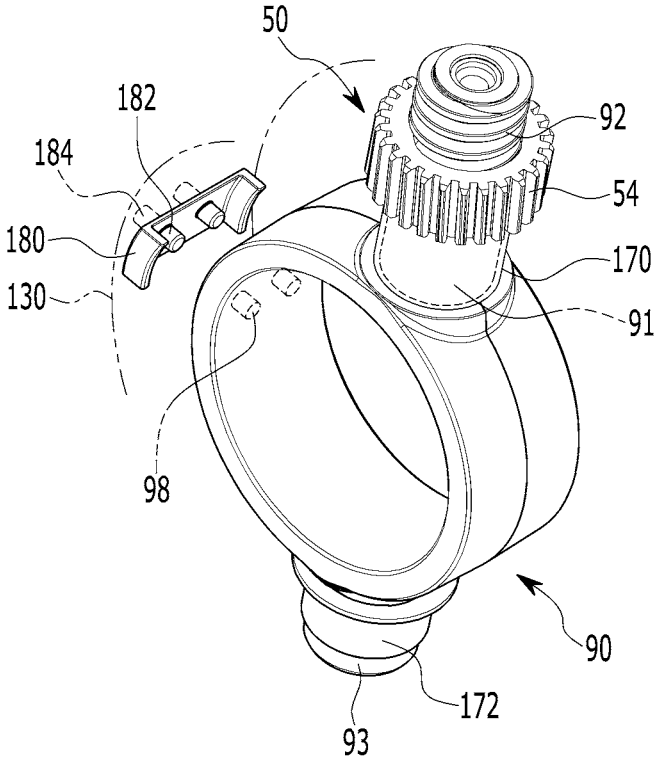
FIG. 6 is a perspective view of a wheel housing applied to a continuously variable valve duration apparatus according to various exemplary embodiments of the present invention.
Figure 7:
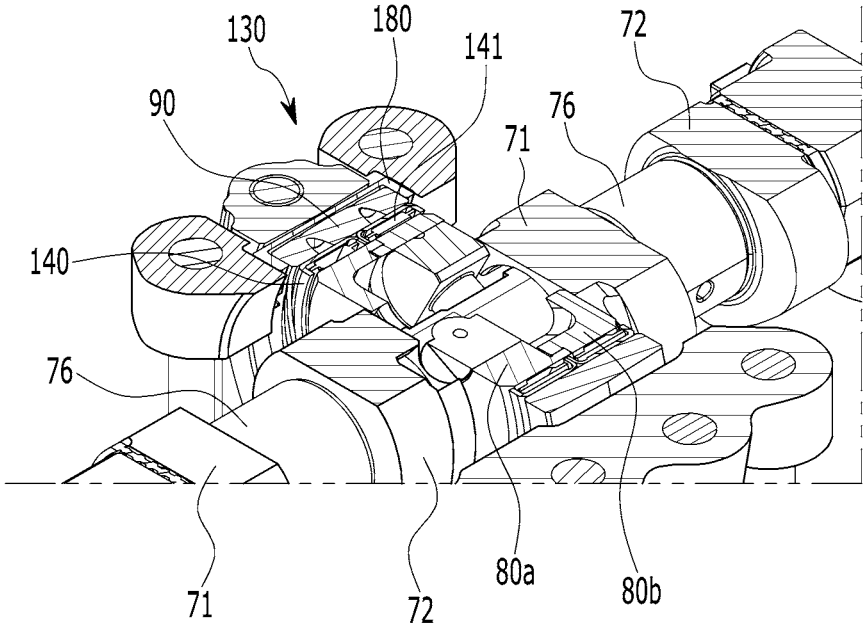
FIG. 7 is a cross-sectional view along line VII-VII of FIG. 1.

FIG. 5 is a cross-sectional view along line V-V of FIG. 1, FIG. 6 is a perspective view of a wheel housing applied to a continuously variable valve duration apparatus according to various exemplary embodiments of the present invention, and FIG. 7 is a cross-sectional view along line VII-VII of FIG. 1.

Referring to FIG. 1 to FIG. 7, an engine 1 according to various exemplary embodiments of the present invention includes a cylinder head 3, an engine block 5, and a continuously variable valve duration apparatus according to various exemplary embodiments of the present invention mounted on the cylinder head 3.

In the drawings, 4 cylinders 211, 212, 213 and 214 are formed at the engine, but it is not limited thereto.

The continuously variable valve duration apparatus according to various exemplary embodiments of the present invention may include a camshaft 30, a cam unit 70 on which a cam 71 is formed, and the camshaft 30 is inserted into the cam unit 70, a guide bracket 130 formed with an upper guide boss 131, an internal wheel 80 configured to transmit rotation of the camshaft 30 to the cam unit 70, a wheel housing 90 in which the internal wheel 80 is rotatably inserted, of which a guide thread 92 is formed thereto, and of which a guide shaft 91 is formed to be movably inserted into the upper guide boss 131, a worm wheel 50 to which an internal thread 52 configured to engage with the guide thread 92 is formed therewithin, and to which an external thread 54 is formed thereon, a control shaft 102 on which a control worm 104 configured to engage with the external thread 54 is formed, and an upper bushing 170 mounted on a lower portion of the upper guide boss 131 to support the guide shaft 91.

The camshaft 30 may be an intake camshaft or an exhaust camshaft.

A control shaft hole 132 supporting the control shaft 102 is formed at the guide bracket 130, and a control shaft bearing 160 is mounted on the control shaft hole 132 to support rotation of the control shaft 102.

A thrust bearing 150 is mounted on the guide boss 131 to support the worm wheel 50, and as shown in the drawing, the thrust bearing 150 may be mounted above and below the worm wheel 50, respectively.

A worm cap 152 may be coupled to the guide bracket 130 to support the thrust bearing 150. For example, the worm cap 152 may be coupled to the guide bracket 130 by caulking.

Referring to FIG. 5, the internal thread 52 and the guide thread 92 of the worm wheel 50 may be trapezoidal threads. Therefore, the rotation of the control shaft 102 is transmitted to the worm wheel 50, so that the vertical movement of the wheel housing 90 may be smoothly controlled.

The thrust bearing 150 allows the worm wheel 50 to rotate smoothly, and the worm cap 152 fixes the position of the worm wheel 50.

Therefore, the worm wheel 50 is mounted at a fixed position of the guide bracket 130, and the wheel housing 90 can move smoothly in the up and down directions of the drawing according to the rotation of the worm wheel 50.

A lower guide boss 133 is formed at the guide bracket 130, and a guide rod 94 inserted into the lower guide boss 133 is formed at the wheel housing 90 to guide the movement of the wheel housing 90. The guide rod 94 guides the movement of the wheel housing 90 and prevents the wheel housing 90 from vibration.

A lower bushing 172 supporting the guide rod 94 may be mounted on the lower portion of the lower guide boss 133.

The bushings 170 and 172 are applied between the wheel housing 90 and the guide bracket 130 to prevent shaking or vibration of the wheel housing 90 and wear as well as to reinforce strength. For example, the wheel housing 90 and the guide bracket 130 are formed of aluminum material, and the upper bushing 170 and the lower bushing 172 are formed of steel material to stably support the movement of the wheel housing 90, and the thickness of the upper guide boss 131 and the lower guide boss 133 may be reduced.

A center portion B of the internal wheel 80 may be deviated from the imaginary line A connecting the upper guide boss 131 and the lower guide boss 133.

The camshaft 30 and the control shaft 102 may be mounted on a virtual vertical line S. Therefore, it is possible to prevent tool interference when engaging the cam cap with bolts.

Here, the virtual vertical line S phase does not mean that it is on a completely vertical line, but it is a practical vertical line (substantially vertical) phase, which means a configuration configured for minimizing interference when working through a tool.

The center portion B of the internal wheel 80 is offset (A) with the imaginary line A connecting the upper guide boss 131 and the lower guide boss 133, so even if a slight slope is provided to the valve duration apparatus, the camshaft 30 and the control shaft 102 may be mounted on the virtual vertical line S.

In an exemplary embodiment of the present invention, the imaginary line A is aligned along a center axis of the upper guide boss 131 and a center axis of the lower guide boss 133.

The continuously variable valve duration apparatus according to various exemplary embodiments of the present invention may further include an insert 180 located between the wheel housing 90 and the guide bracket 130.

The insert 180 may be fixed to either the wheel housing 90 or the guide bracket 130.

For example, a fixing hole 98 may be formed at the wheel housing 90, an insert protrusion 182 may be formed to internal side of the insert 180, and the insert protrusion 182 may be coupled to the fixing hole 98. Conversely, a hole is formed in the guide bracket 130, and an insert protrusion 184 is formed to external side of the insert 180, so that the insert 180 may be coupled to the guide bracket 130.

Furthermore, the insert 180 may be connected to one of the wheel housing 90 and the guide bracket 130 by bolting, fitting, or may be bonded and fixed.

The insert 180 may be formed from a plastic material. When the wheel housing 90 and the guide bracket 130 made of metal materials contact each other, noise and vibration may occur. However, the insert 180 made of plastic material is located between the wheel housing 90 and the guide bracket 130 to act as a damping function to suppress noise and vibration. For example, the insert 180 may be formed from a wear-resistant engineering plastic such as PA66, but is not limited thereto.

A cross-section of the insert 180 is formed in a "U" shape. Therefore, the insert 180 surrounds the wheel housing 90 and prevents the insert 180 from being separated, and it is possible to prevent the wheel housing 90 from rotating around the upper guide boss 131 and the lower guide boss 133.

The wheel housing 90 has an upper stopper 95 and a lower stopper 96 that contact with the guide bracket 130 to limit the movement of the wheel housing 90.

Figure 8:
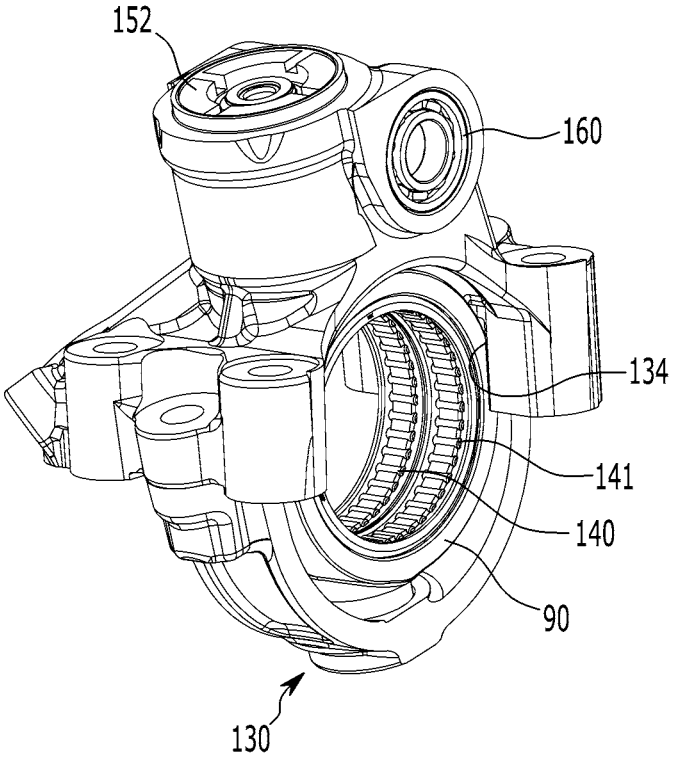
FIG. 8 is a perspective view of a guide bracket applied to a continuously variable valve duration apparatus according to various exemplary embodiments of the present invention.

FIG. 8 is a perspective view of a guide bracket applied to a continuously variable valve duration apparatus according to various exemplary embodiments of the present invention.

Referring to FIG. 8, a stepped surface 134 that prevents rotation of the wheel housing 90 is formed at the guide bracket 130.

In the guide bracket 130, the upper guide boss 131 and the lower guide boss 133 are formed, so that the wheel housing 90 rotates during operation of the instrument, which may cause uneven wear.

According to various exemplary embodiments of the present invention, the stepped surface 134 is formed on the guide bracket 130, especially formed on the boss for engaging bolts on the side, reducing the number of portions and preventing rotation of the wheel housing 90.

Figure 9:
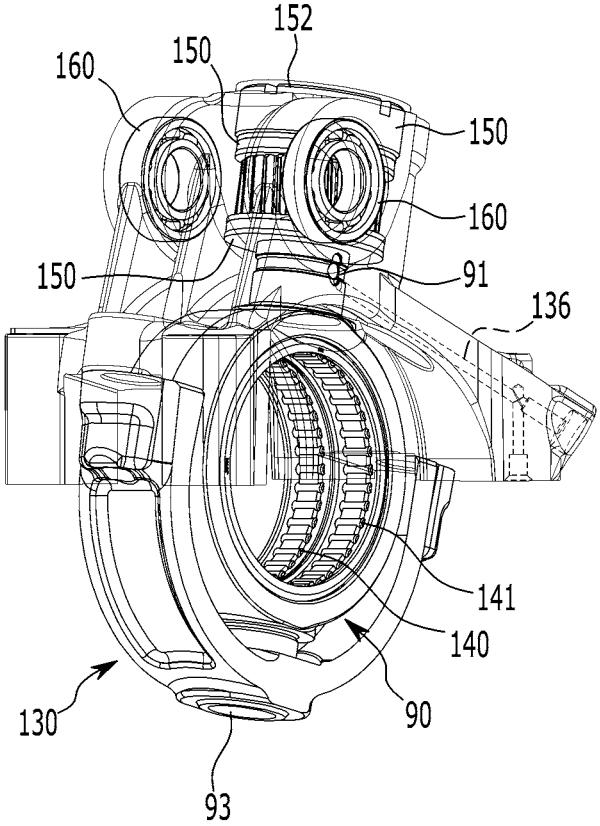
FIG. 9 is a partial projection view of a guide bracket applied to a continuously variable valve duration apparatus according to various exemplary embodiments of the present invention.

FIG. 9 is a partial projection view of a guide bracket applied to a continuously variable valve duration apparatus according to various exemplary embodiments of the present invention.

Referring to FIG. 9, a bracket oil hole 136 that supplies lubrication oil to the worm wheel 50 may be formed in the guide bracket 130.

In various exemplary embodiments of the present invention, the control shaft bearing 160 and the worm cap 152 form a single chamber and supply oil to the worm wheel 50 through the bracket oil hole 136. It is possible to minimize the oil pressure loss and supply oil appropriate to each portion.

Figure 10:
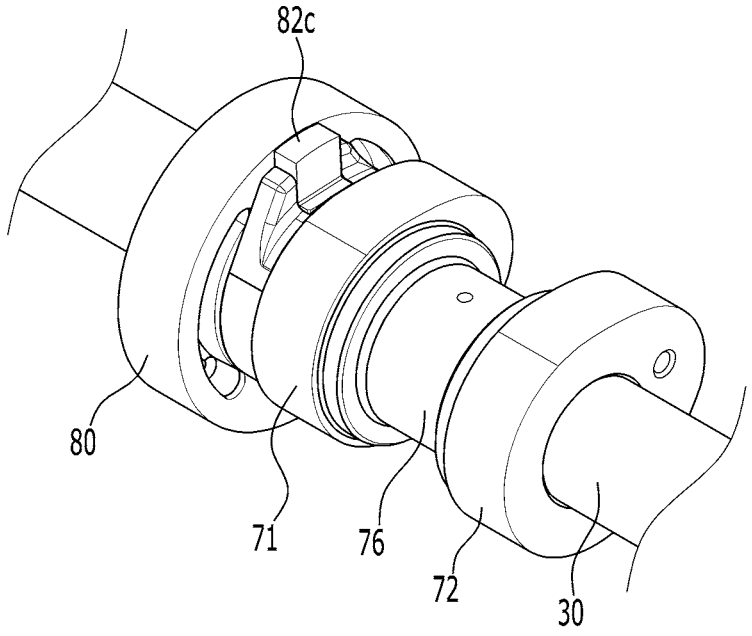
FIG. 10 is a perspective view showing an internal wheel and a cam unit applied to a continuously variable valve duration apparatus according to various exemplary embodiments of the present invention.
Figure 11:
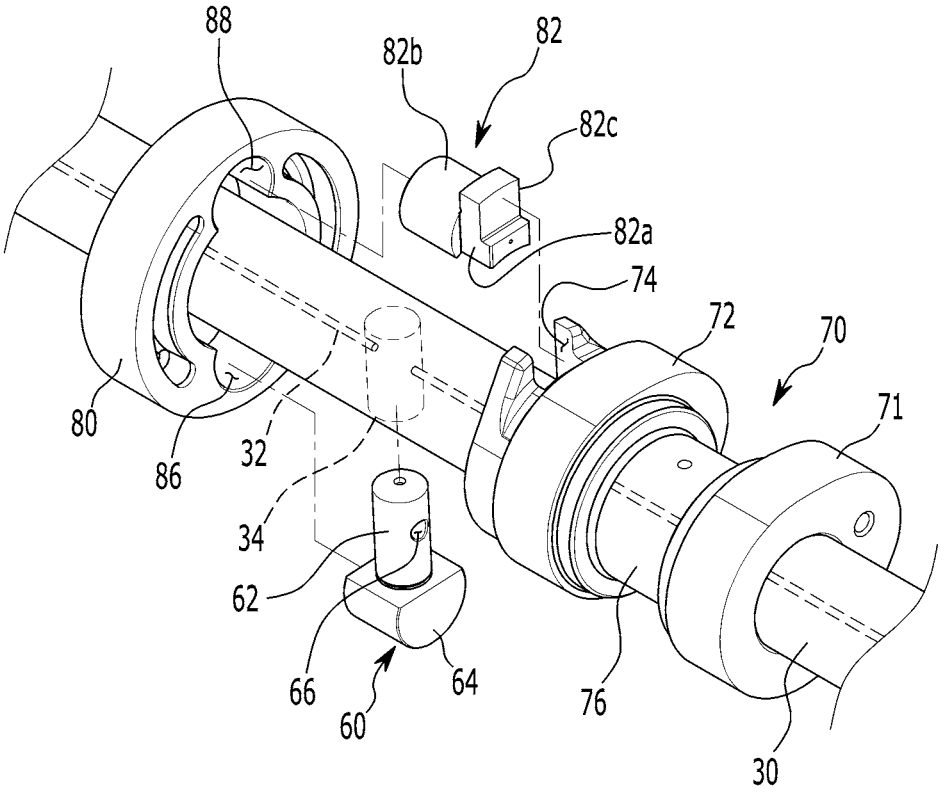
FIG. 11 is an exploded perspective view showing an internal wheel and a cam unit applied to a continuously variable valve duration apparatus according to various exemplary embodiments of the present invention.

FIG. 10 is a perspective view showing an internal wheel and a cam unit applied to a continuously variable valve duration apparatus according to various exemplary embodiments of the present invention, and FIG. 11 is an exploded perspective view showing an internal wheel and a cam unit applied to a continuously variable valve duration apparatus according to various exemplary embodiments of the present invention.

Referring to FIG. 1 to FIG. 11, first and second sliding holes 86 and 88 are formed at the internal wheel 80, and cam slot 74 is formed at the cam unit 70.

The continuously variable valve duration apparatus further includes a roller wheel 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a cam head 82*b* rotatably inserted into the second sliding hole 88.

A protrusion 82*c* is formed at the roller cam 82 for preventing the roller cam 82 from being separated from the internal wheel 80 in the longitudinal direction of the camshaft 30.

The roller wheel 60 includes a wheel body 62 slidably connected to the camshaft 30 and a wheel head 64 rotatably inserted into the first sliding hole 86 and the wheel body 62 and the wheel head 64 may be integrally formed.

A camshaft hole 34 is formed at the camshaft 30, the wheel body 62 of the roller wheel 60 is movably inserted into the camshaft hole 34 and the wheel head 64 is rotatably inserted into the first sliding hole 86.

A camshaft oil hole 32 is formed within the camshaft 30 in a longitudinal direction thereof, a body oil hole 66 communicating with the camshaft oil hole 32 is formed at the wheel body 62 of the roller wheel 60 and an oil groove 68 (referring to FIG. 14) communicating with the body oil hole 66 is formed at the wheel head 64 of the roller wheel 60.

Lubricant supplied to the camshaft oil hole 32 may be supplied to the internal wheel 80 through the body oil hole 66, the communicate hole 69 and the oil groove 68.

Figure 12:
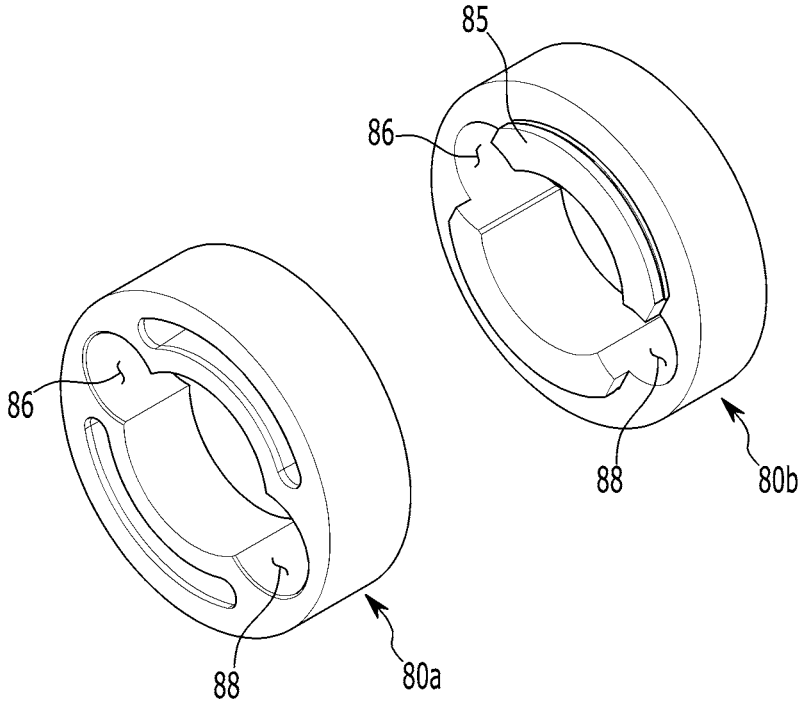
FIG. 12 is a perspective view of an internal wheel of a continuously variable valve duration apparatus according to various exemplary embodiments of the present invention.
Figure 13:
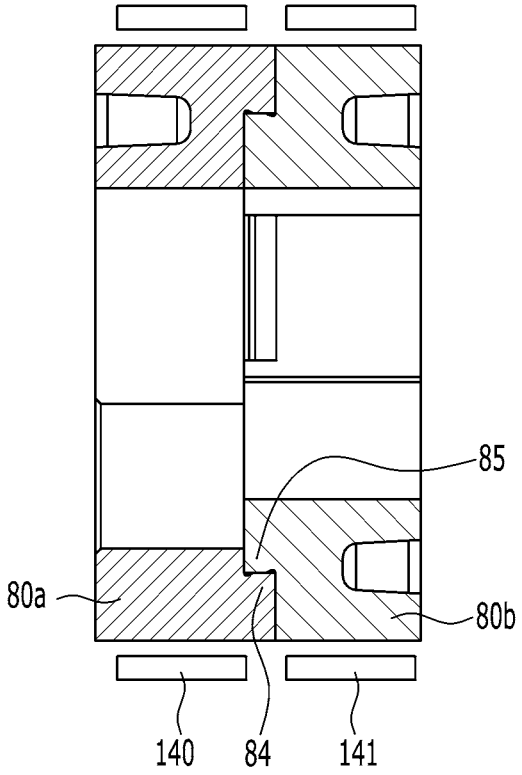
FIG. 13 is a cross-sectional view of an internal wheel of a continuously variable valve duration apparatus according to various exemplary embodiments of the present invention.

FIG. 12 is a perspective view of an internal wheel of a continuously variable valve duration apparatus according to various exemplary embodiments of the present invention, and FIG. 13 is a cross-sectional view of an internal wheel of a continuously variable valve duration apparatus according to various exemplary embodiments of the present invention.

Referring to FIG. 2, FIG. 12 and FIG. 13, the cam unit 70 includes a first cam portion 70*a* and a second cam portion 70*b* which are disposed corresponding to a cylinder and an adjacent cylinder respectively, for example the first cylinder 201 and the adjacent second cylinder 202 and the internal wheel 80 includes a first internal wheel 80*a* and a second internal wheel 80*b* transmitting rotation of the camshaft 30 to the first cam portion 70*a* and the second cam portion 70*b* respectively.

The continuously variable valve duration apparatus further includes first and second bearings 140, and 141*a* internally disposed within the wheel housing 90 for supporting the first internal wheel 80*a* and the second internal wheel 80*b*.

The first and second bearings 140 and 141*a* may be a needle bearing, the first and the second internal wheels 80*a* and 80*b* are internally disposed within one wheel housing 90 and the first and second bearings 140, and 141*a* may rotatably support the first and the second internal wheels 80*a* and 80*b*.

Since the first and the second internal wheels 80*a* and 80*b* may be internally disposed within one wheel housing 90, element numbers may be reduced, so that productivity and manufacturing economy may be enhanced.

The first internal wheel 80*a* and the second internal wheel 80*b* within the wheel housing 90 may be connected rotatable to each other. For example, a first internal wheel connecting portion 84 and a second internal wheel connecting portion 85 are formed at the first internal wheel 80*a* and the second internal wheel 80*b* respectively, and the first internal wheel connecting portion 84 and the second internal wheel connecting portion 85 are connected to each other.

In the drawing, the first internal wheel connecting portion 84 and the second internal wheel connecting portion 85 are formed as convex and concave, it is not limited thereto. The first internal wheel 80*a* and the second internal wheel 80*b* are rotatably connected to each other with variable connecting structures.

In the case that the first internal wheel 80*a* and the second internal wheel 80*b* are connected, looseness or vibration due to manufacturing tolerances of the bearing, the internal wheel, the lifter and the like may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

Figure 14:
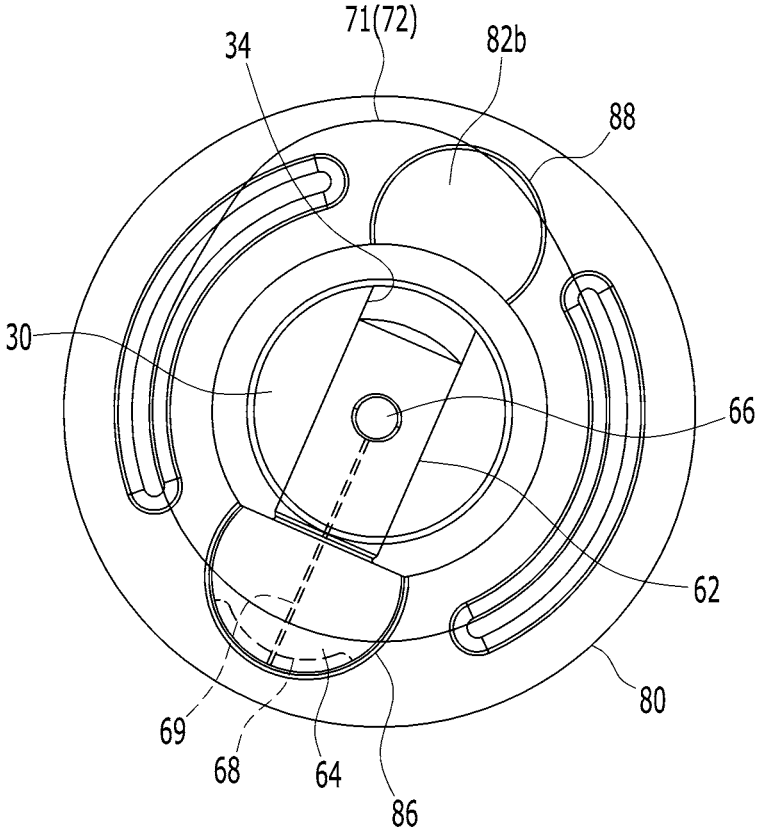
FIG. 14, FIG. 15 and FIG. 16 are drawings illustrating an operation of a continuously variable valve duration apparatus according to various exemplary embodiments of the present invention.
Figure 15:
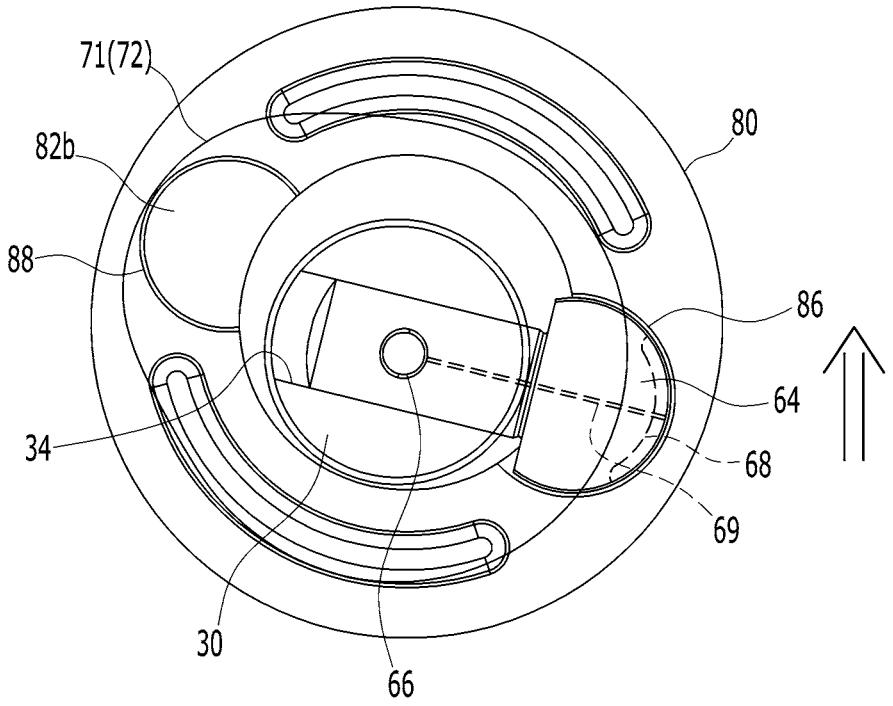
Figure 16:
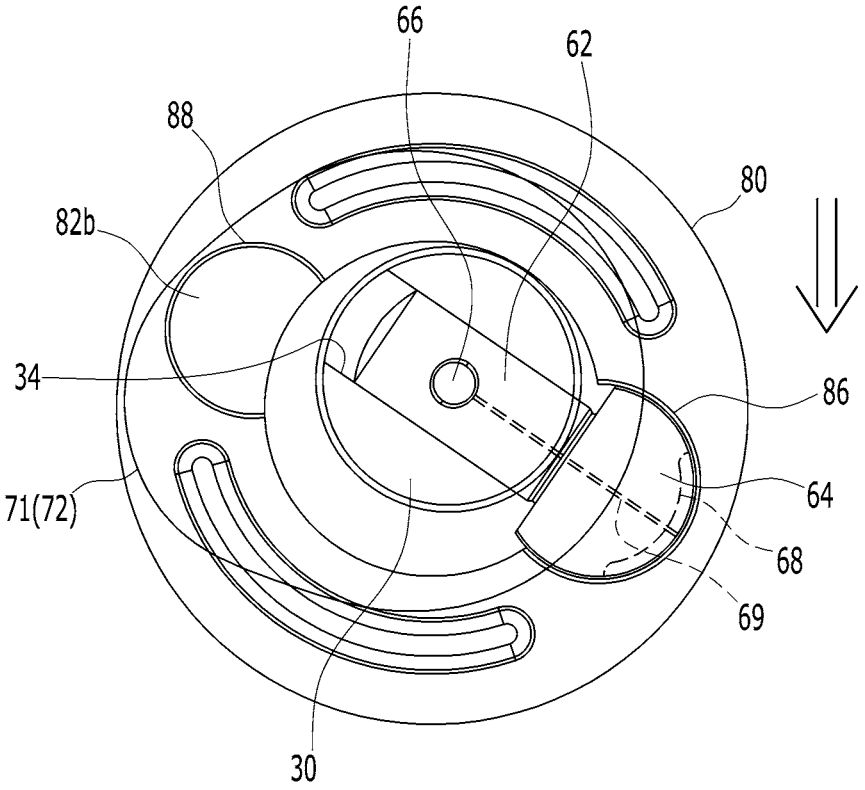

FIG. 14, FIG. 15 and FIG. 16 are drawings illustrating an operation of a continuously variable valve duration apparatus according to various exemplary embodiments of the present invention.

As shown in FIG. 14, when rotation centers of the camshaft 30 and the cam unit 70 are coincident, the cams 71 and 72 rotate with the same phase angle of the camshaft 30.

According to engine operation states, an ECU (engine control unit or electric control unit) transmits control signals to the control portion 100, and then the control motor 106 rotates the control shaft 102.

Referring to FIG. 5, FIG. 15 and FIG. 16, the control worm 104 engaged with the external thread 54 rotates the worm wheel 50 and since the internal thread 52 formed at the worm wheel 50 is engaged with the guide thread 130, the worm wheel 50 moves along the guide thread 130.

That is, the worm wheel 50 rotates by the rotation of the control shaft 102 and changes the relative position of the wheel housing 90 to the camshaft 30.

When the position of the wheel housing 90 moves upper or lower relative to the rotation center portion of the camshaft 30, the relative rotation speed of the cams 71 and 72 with respect to the rotation speed of the camshaft 30 are changed.

While the slider pin 60 is rotated with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 17A:
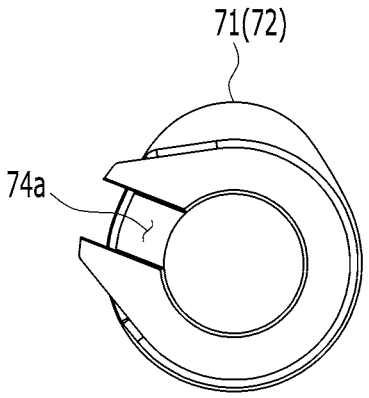
FIG. 17A and FIG. 17B are a drawing showing a cam slot of a continuously variable valve duration apparatus according to various exemplary embodiments of the present invention.
Figure 17B:
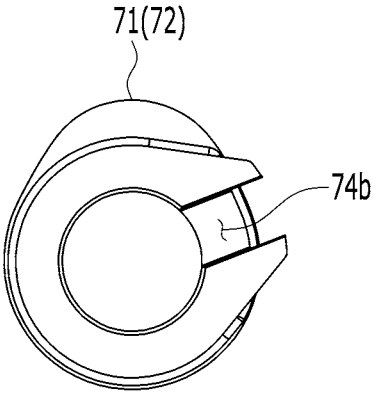
Figure 18A:
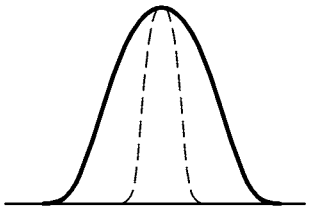
FIG. 18A, FIG. 18B and FIG. 18C are a graphs showing valve profile of a continuously variable valve duration apparatus according to various exemplary embodiments of the present invention.
Figure 18B:
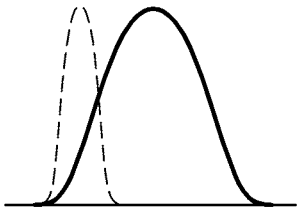
Figure 18C:
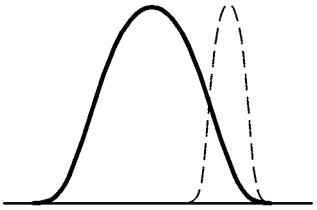

FIG. 17A and FIG. 17B are a drawing showing a cam slot of a continuously variable valve duration apparatus according to various exemplary embodiments of the present invention, and FIG. 18A, FIG. 18B and FIG. 18C are a graphs showing valve profile of a continuously variable valve duration apparatus according to various exemplary embodiments of the present invention.

As shown in FIG. 17A and FIG. 17B, the cam slot 74 may be formed more retarded than a position of the cam 71 or 72 (referring to FIG. 17A) or the cam slot 74 may be formed more advanced than a position of the cam 71 or 72 (referring to FIG. 17B), or the cam slot 74 may be formed with the same phase of the cam 71 or 72. With the above scheme, various valve profiles may be achieved.

Although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

According to the relative position of the cam slot 74, mounting angle of the valve 200 and the like, opening and closing time of the valve may be simultaneously changed as shown in FIG. 18A.

While opening time of the valve 200 is constant, closing time of the valve 200 may be retarded or advanced as shown in FIG. 18B.

While closing time of the valve 200 is constant, opening time of the valve 200 may be retarded or advanced as shown in FIG. 18C.

As described above, a continuously variable valve duration apparatus according to various exemplary embodiments of the present invention may achieve various valve duration with a simple construction.

The continuously variable valve duration apparatus according to various exemplary embodiments of the present invention may be reduced in size and thus an entire height of a valve train may be reduced.

Since the continuously variable valve duration apparatus may be applied to an existing engine without excessive modification, thus productivity may be enhanced and production cost may be reduced.

The continuously variable valve duration apparatus according to various exemplary embodiments of the present invention can reduce the number of portions and reduce vibration and noise by applying a worm wheel.

In various exemplary embodiments of the present invention, the continuously variable valve duration apparatus is configured for preventing wear and reinforcing strength by applying a bushing between the wheel housing and the guide bracket.

The continuously variable valve duration apparatus according to various exemplary embodiments of the present invention prevents rotation of the wheel housing by applying an insert between the wheel housing and the guide bracket, and reduces noise and vibration.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A valve duration control apparatus comprising:

a camshaft;

a cam unit on which a cam is formed, wherein the camshaft is inserted into the cam unit;

a guide bracket including an upper guide boss;

an internal wheel configured to transmit a rotation of the camshaft to the cam unit;

a wheel housing in which the internal wheel is rotatably inserted, wherein a guide thread is formed in a portion of the wheel housing, and wherein the wheel housing includes a guide shaft movably inserted into the upper guide boss;

a worm wheel to which an internal thread engaging with the guide thread is formed in the worm wheel, wherein an external thread is formed on the worm wheel;

a control shaft including a control worm engaged with the external thread; and an upper bushing mounted on a lower portion of the upper guide boss to support the guide shaft.

2. The valve duration control apparatus of claim 1, wherein the guide bracket further includes a lower guide boss, and wherein the wheel housing includes a guide rod inserted into the lower guide boss to guide a movement of the wheel housing.

3. The valve duration control apparatus of claim 2, further including a lower bushing mounted on a lower portion of the lower guide boss to support the guide rod.

4. The valve duration control apparatus of claim 2, wherein a center portion of the internal wheel is aligned to deviate from an imaginary line connecting the upper guide boss and the lower guide boss.

5. The valve duration control apparatus of claim 1, further including an insert mounted between the wheel housing and the guide bracket.

6. The valve duration control apparatus of claim 5, wherein the insert is fixed to one of the wheel housing and the guide bracket.

7. The valve duration control apparatus of claim 5, wherein the insert is made of plastic material.

8. The valve duration control apparatus of claim 5, wherein a cross-section of the insert is formed in a "U" shape.

9. The valve duration control apparatus of claim 1, wherein a control shaft hole that supports the control shaft is formed at the guide bracket.

10. The valve duration control apparatus of claim 9, further including a control shaft bearing mounted on the control shaft hole to support rotatably the control shaft.

11. The valve duration control apparatus of claim 1, further including a thrust bearing mounted on the upper guide boss to support the worm wheel.

12. The valve duration control apparatus of claim 1, further including a stepped surface formed at the guide bracket to prevent a rotation of the wheel housing.

13. The valve duration control apparatus of claim 1, further including:

a first sliding hole and a second sliding hole respectively formed at the internal wheel;

a cam slot formed at the cam unit;

a roller wheel connected to the camshaft and rotatably inserted into the first sliding hole; and a roller cam slidably inserted into the cam slot and rotatably inserted into the second sliding hole.

14. The valve duration control apparatus of claim 13, wherein the roller cam includes:

a roller cam body slidably inserted into the cam slot;

a cam head rotatably inserted into the second sliding hole; and a protrusion formed in a longitudinal direction of the camshaft and configured to inhibit the roller cam from being removed from the internal wheel.

15. The valve duration control apparatus of claim 14, wherein the roller wheel includes:

a wheel body slidably connected to the camshaft; and a wheel head rotatably inserted into the first sliding hole.

16. The valve duration control apparatus of claim 15, further including:

a camshaft oil hole formed within the camshaft in a longitudinal direction of the camshaft;

a body oil hole formed at the wheel body of the roller wheel and fluidically-communicating with the camshaft oil hole; and an oil groove formed at the wheel head of the roller wheel and fluidically-communicating with the body oil hole.

17. The valve duration control apparatus of claim 1, wherein the cam unit includes a first cam portion and a second cam portion which are mounted corresponding to a cylinder and an adjacent cylinder respectively, and wherein the internal wheel includes a first internal wheel and a second internal wheel of transmitting the rotation of the camshaft to the first cam portion and the second cam portion, respectively.

18. The valve duration control apparatus of claim 17, wherein the first internal wheel and the second internal wheel are rotatably connected to each other.

19. The valve duration control apparatus of claim 17, further including first and second bearings internally mounted within the wheel housing and supporting the first internal wheel and the second internal wheel respectively.

20. An engine mounted with including the valve duration control apparatus of claim 1.

* * * * *